United States Patent [19]

Yuasa et al.

[11] Patent Number: 4,675,459

[45] **Date of Patent: * Jun. 23, 1987**

[54] TRACTION DRIVE FLUID

[75] Inventors: Hitoshi Yuasa; Mitsuo Matsuno, both of Yokohama, Japan

[73] Assignee: Nippon Oil Company, Ltd., Tokyo, Japan

[ * ] Notice: The portion of the term of this patent subsequent to Aug. 5, 2003 has been disclaimed.

[21] Appl. No.: 881,054

[22] Filed: Jul. 1, 1986

[30] Foreign Application Priority Data

Jul. 2, 1985 [JP] Japan ..... 60-143957

[51] Int. Cl.[4] ..... C07C 13/28

[52] U.S. Cl. ..... 585/21; 252/56 R; 252/49.8; 585/3; 585/22; 585/23; 585/361

[58] Field of Search ..... 585/3, 21, 22, 23, 361; 252/29.8, 56 R, 32.7, 49.8

[56] References Cited

U.S. PATENT DOCUMENTS

| | | | |
|---|---|---|---|
| 3,144,491 | 8/1964 | O'Connor et al. | 585/23 |
| 3,646,232 | 2/1972 | Foster et al. | 585/23 |
| 3,660,508 | 5/1972 | Dart et al. | 585/23 |
| 4,604,490 | 8/1986 | Yuasa et al. | 585/21 |

*Primary Examiner*—Asok Pal

*Attorney, Agent, or Firm*—Wenderoth, Lind & Ponack

[57] ABSTRACT

A traction drive fluid comprising as a base stock at least one hydrocarbon selected from the group consisting of compounds of the following general formulae (I) to (V)

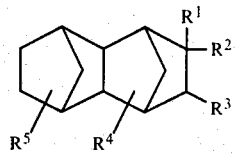

(I)

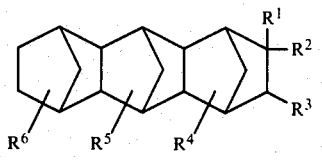

(II)

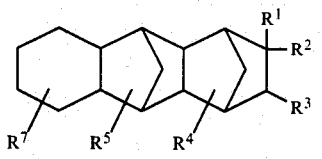

(III)

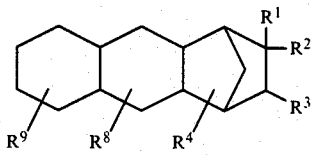

(IV)

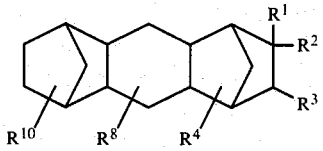

(V)

wherein $R^1$, $R^2$ and $R^3$, independently from each other, represent a hydrogen atom or an alkyl group having 1 to 3 carbon atoms, and $R^4$, $R^5$, $R^6$, $R^7$, $R^8$, $R^9$ and $R^{10}$, independently from each other, represent a hydrogen atom or a methyl group.

13 Claims, No Drawings

TRACTION DRIVE FLUID

BACKGROUND OF THE INVENTION

1. Field of the Invention

This invention relates to a fluid for a traction drive (rolling friction drive device), and more specifically, to a traction drive fluid which has a high traction coefficient and excellent stability to heat and oxidation and is economically advantageous.

1. Description of the Prior Art

In traction drive transmissions, it is required that the traction fluid lose its fluidity by entering a rolling contact point to form a film thereof, at which contact point two cylinders or cones rolling in the directions opposite to each other about their respective fixed rotation axes contact each other at the surface, and that the traction fluid recover its original fluidity on leaving the contact point. In other words, the traction fluid desirably exhibits high rolling friction in use since power is transmitted by means of rolling friction caused by hardening of the film of the traction fluid (the traction fluid in filmy state at high pressures) at the rolling contact point in the traction drive transmissions. The rolling friction property required of a traction fluid is expressed by a rolling friction coefficient measured in a predetermined traction drive transmission.

Various compounds have heretofore been proposed as fluids for traction drives. They include, for example, decalin, perhydroanthracene (U.S. Pat. No. 3,411,369), polycyclohexyls (U.S. Pat. No. 3,925,217), 2,3-dicyclohexylbutanes (Japanese Laid-Open Patent Publication No. 4510/1971), a hydrogenation product of an isobutylene low polymer (Japanese Laid-Open Patent Publications Nos. 4766/1971, 2164/1972, 35661/1972 and 2229/1972), a hydrogenation product of a cyclic dimer of alpha-methylstyrene (Japanese Laid-Open Patent Publication No. 2229/1972 and Japanese Patent Publication No. 35763/1972), a hydrogenation product of a linear dimer of alpha-methylstyrene (Japanese Laid-Open Patent Publication No. 7664/1972 and U.S. Pat. Nos. 3,975,278 and 3,994,816), and adamantanes (Japanese Patent Publications Nos. 42067/1973, 42068/1973 and 35763/1972). Many of these compounds are insufficient in practical properties, particularly a rolling friction coefficient, i.e. a traction coefficient. Some of these compounds such as the linear dimer of alpha-methylstyrene, have satisfactory practical properties, but are not economically advantageous because the starting materials for their production are expensive or the occurrence of side-reactions during their production decrease the yields of the desired products.

SUMMARY OF THE INVENTION

It has an object of this invention to provide a traction drive fluid having high performance, which meets the aforesaid requirements of traction drive fluids, and can be easily produced industrially at low costs.

The object of the invention is achieved by a traction drive fluid comprising as a base stock at least one hydrocarbon selected from the group consisting of compounds of the following formulae (I) to (V)

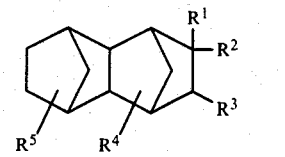

(I)

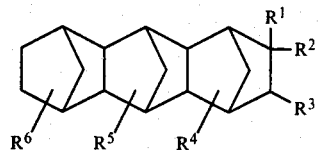

(II)

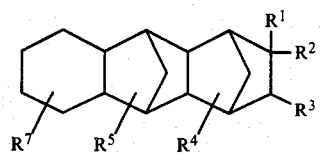

(III)

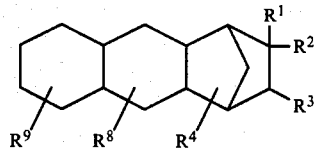

(IV)

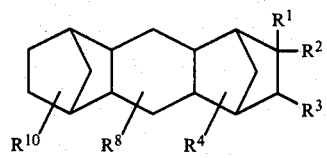

(V)

wherein $R^1$, $R^2$ and $R^3$, independently from each other, represent a hydrogen atom or an alkyl group having 1 to 3 carbon atoms, and $R^4$, $R^5$, $R^6$, $R^7$, $R^8$, $R^9$ and $R^{10}$, independently from each other, represent a hydrogen atom or a methyl group.

DETAILED DESCRIPTION OF PREFERRED EMBODIMENTS OF THE INVENTION

The compounds of general formulae (I) to (V) can be produced by various methods, and any compounds produced by such methods can be used in this invention. A general method of production comprises synthesis of an unsaturated polycyclic hydrocarbon by utilizing the Diels-Alder reaction, and subsequent hydrogenation of the unsaturated hydrocarbon, as specifically described below.

Diels-Alder reaction of an unsaturated hydrocarbon having 2 to 11 carbon atoms with cyclopentadiene and/or methylcyclopentadiene proceeds to give a norbornene compound (VI), as schematically shown below.

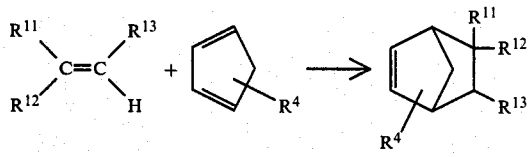

(I)

(VI)

In the above scheme, $R^{11}$, $R^{12}$ and $R^{13}$ each represent a hydrogen atom, or an alkyl, alkenyl or alkylidene group having 1 to 3 carbon atoms and $R^4$ is as defined hereinabove.

When the norbornene compound (VI) is subjected to Diels-Alder reaction with cyclopentadiene and/or methylcyclopentadiene, a 1:1 adduct (VII) and a 1:2 adduct (VIII) of the norbornene compound (VI) and cyclopentadiene and/or methylcyclopentadiene can be synthesized. The 1:2 adduct (VIII) can also be synthesized by first synthesizing the 1:1 adduct (VII) in accordance with the following scheme (2) and then reacting it with cyclopentadiene and/or methylcyclopentadiene.

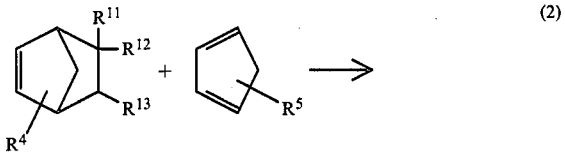

(2)

(VI)

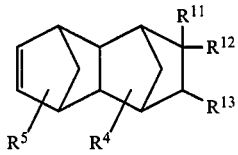

(VII)

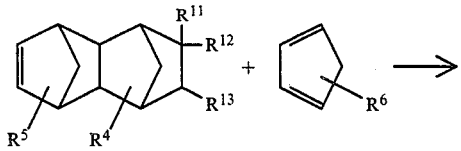

(3)

(VII)

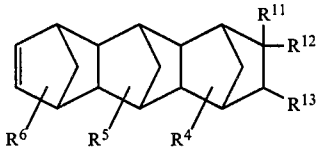

(VIII)

In the above schemes, $R^{11}$, $R^{12}$, $R^{13}$, $R^4$, $R^5$ and $R^6$ are as defined hereinabove.

The resulting compound (VII) is subjected to Diels-Alder reaction with at least one conjugated diene selected from the group consisting of butadiene, isoprene and piperylene, an adduct (IX) can be synthesized as shown below.

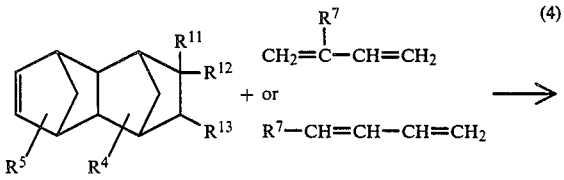

(4)

(VII)

-continued

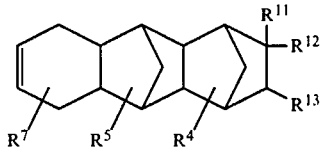

(IX)

In the above scheme (4), $R^{11}$, $R^{12}$, $R^{13}$, $R^4$, $R^5$ and $R^7$ are as defined hereinabove.

When the norbornene compound (VI) obtained by the Diels-Alder reaction of an unsaturated hydrocarbon having 2 to 11 carbon atoms and cyclopentadiene and/or methylcyclopentadiene in accordance with the scheme (1) is subjected to Diels-Alder reaction with at least one conjugated diene selected from the group consisting of butadiene, isoprene and piperylene, a 1:1 adduct (X) and a 1:2 adduct (XI) of the norbornene compound (VI) and the conjugated diene can be synthesized as schematically shown below.

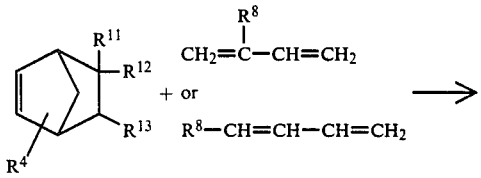

(5)

(VI)

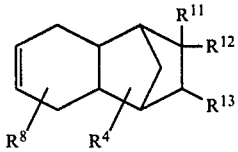

(X)

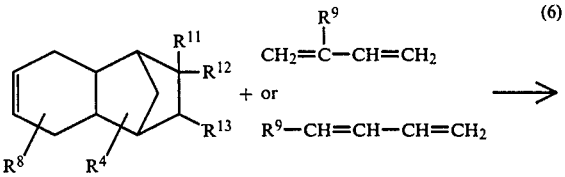

(6)

(X)

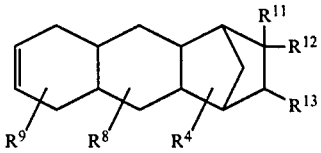

(XI)

In the above scheme, $R^{11}$, $R^{12}$, $R^{13}$, $R^4$, $R^8$ and $R^9$ are as defined hereinabove.

The 1:2 adduct (XI) can also be produced by first synthesizing the 1:1 adduct (X) in accordance with the scheme (5) and then reacting it with at least one conjugated diene selected from the group consisting of butadiene, isoprene and piperylene in accordance with the scheme (6).

Diels-Alder reaction of the compound (X) obtained by the scheme (5) with cyclopentadiene and/or methylcyclopentadiene gives a compound (XII).

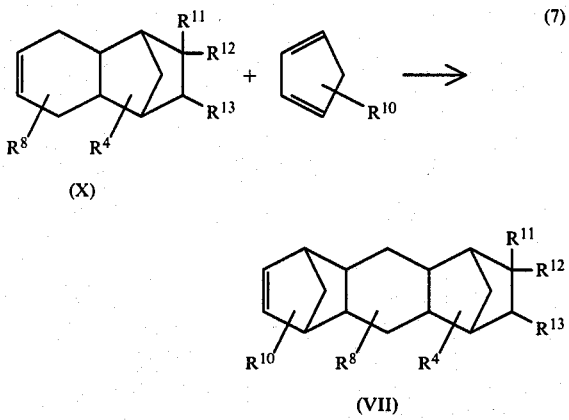

(7)

In the above scheme, $R^{11}$, $R^{12}$, $R^{13}$, $R^4$, $R^8$ and $R^{10}$ are as defined above.

These Diels-Alder reactions are thermal reactions which do not require a catalyst. Accordingly, these reactions can be performed easily and are economically advantageous.

In the Diels-Alder reaction in accordance with the scheme (1), cyclopentadiene and/or methylcyclopentadiene and an unsaturated hydrocarbon of the general formula

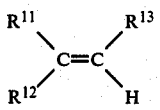

are used. Specific examples of the unsaturated hydrocarbon include ethylene, propylene, 1-butene, 2-butene, isobutylene, 1-pentene, 2-pentene, 2-methyl-1-butene, 2-hexene, 2-methyl-2-pentene, 3-methyl-2-pentene, 3-heptene, 2-ethyl-1-pentene, 4-octene, 3-propyl-2-hexene, 4-propyl-3-heptene, 4-propyl-4-octene, butadiene, isoprene and piperylene. Cyclopentadiene and/or methylcyclopenbtadiene used in the Diels-Alder reaction in each of the schemes (1) to (3) and (7) may be added as a monomer to the reaction mixture. Alternatively, dicyclopentadiene, methyldicyclopentadiene and dimethyldicyclopentadiene which thermally decompose under the reaction conditions to give cyclopentadiene or methylcyclopentadiene may be used as the starting material.

In the Diels-Alder reaction in accordance with each of the above schemes (1) to (3) and (7) in which cyclopentadiene and/or methylcyclopentadiene is used as the starting diene, the starting diene is selected from the group consisting of dicyclopentadiene, methyldicyclopentadiene and dimethyldicyclopentadiene.

The mole ratio of the diene to the dienophile is from 1:200 to 1:0.1, preferably from 1:100 to 1:0.2. When the 1:2 adduct (VIII) is to be synthesized by the Diels-Alder reaction of the norbornene compound (VI) and cyclopentadiene and/or methylcyclopentadiene without separating the 1:1 adduct (VII) from the reaction system, the mole ratio of cyclopentadiene, methylcyclopentadiene or the dimers of these which thermally decompose to form these dienes to the norbornene compound (VI) is from 1:2 to 1:0.05, preferably from 1:1 to 1:0.1. In any of the reaction schemes (1) to (3) and (7), the reaction temperature of the Diels-Alder reaction is 50° to 250° C., preferably 80° to 200° C., when cyclopentadiene and methylcyclopentadiene are used as starting dienes, and 140° to 250° C., preferably 160° to 200° C., when dicyclopentadiene, methyldicyclopentadiene or dimethyldicyclopentadiene are used as starting dienes.

On the other hand, in the Diels-Alder reactions in accordance with the reaction schemes (4) to (6) in which a conjugated diene such as butadiene, isoprene or piperylene is used as a starting material, the mole ratio of at least one conjugated diene selected from butadiene, isoprene and piperylene to the dienophile is from 1:100 to 1:0.1, preferably from 1:50 to 1:0.2. When the 1:2 adduct (XI) is to be synthesized without separating the 1:1 adduct (X) in the Diels-Alder reaction of the norbornene compound (VI) and at least one conjugated diene selected from butadiene, iosoprene and piperylene, the mole ratio of at least one conjugated diene selected from butadiene, isoprene and piperylene to the norbornene compound (VI) is from 1:3 to 1:0.1, preferably 1:1 to 1:0.2. In the Diels-Alder reactions of formulae (4) to (6) using butadiene, isoprene and piperylene as starting dienes, the reaction temperature is 70° to 250° C., preferably 80° to 200° C.

The reaction time may vary depending upon the reaction temperature in the Diels-Alder reactions mentioned above. In any of the cases, it is 10 minutes to 40 hours, preferably 30 minutes to 30 hours. In these Diels-Alder reactions, a polymerization inhibitor such as hydroquinone, p-phenylenediamine and t-butylcatechol may be added in order to inhibit the formation of a polymer. These reactions may be carried out in a hydrocarbon solvent which does not impede the reaction, for example, lower alcohols (methanol or ethanol), toluene, or cyclophexane. These Diels-Alder reactions may be carried out batchwise, semibatchwise, or continuously. After the reaction, the desired product can be obtained by distilling the reaction mixture.

The adducts of formulae (VII), (VIII), (IX), (XI) and (XII) synthesized and purified by the above procedures have at least one double bond and therefore lack stability to heat and oxidation. It is necessary therefore to convert them into saturated hydrocarbons by hydrogenation in order to use them as traction drives fluids as schematically shown below.

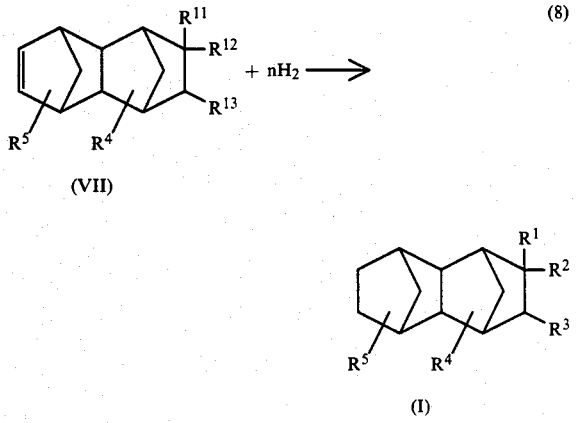

(8)

-continued (9)

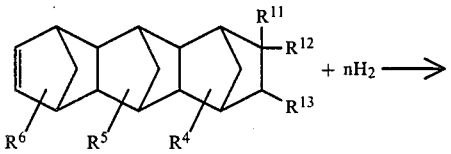

(VIII)

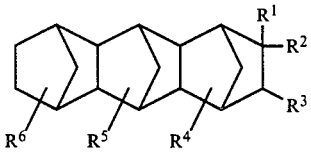

(II)

(10)

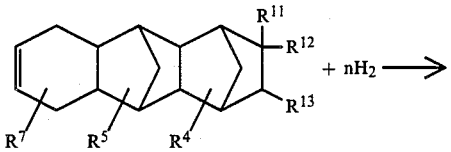

(IX)

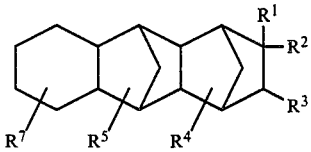

(III)

(11)

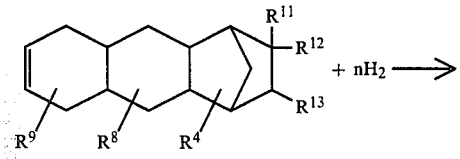

(XI)

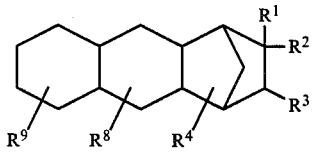

(IV)

(12)

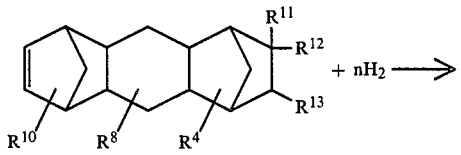

(XII)

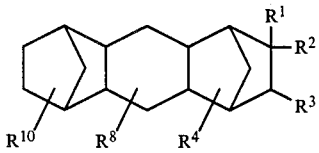

(V)

In the above schemes, $R^1$, $R^2$, $R^3$, $R^4$, $R^5$, $R^6$, $R^7$, $R^8$, $R^9$, $R^{10}$, $R^{11}$, $R^{12}$ and $R^{13}$ are as defined above.

The hydrogenation reaction can be carried out under the same conditions as in the hydrogenation of ordinary unsaturated hydrocarbons. Specifically, the hydrogenation can be easily carried out at a temperature of 20° to 225° C. and a hydrogen pressure of 1 to 200 kg/cm$^2$ using a hydrogenation catalyst such as a noble metal (palladium, rhodium, ruthenium, etc.) or Raney nickel. This hydrogenation reaction can be carried out in the absence of a solvent, but may also be carried out in a solvent such as hydrocarbons, alcohols, esters or ethers. After the hydrogenation, the solvent and the catalyst residue are removed by such an operation as filtration or distillation and hydrogenation products of formulae (I) to (V) are isolated.

(I)

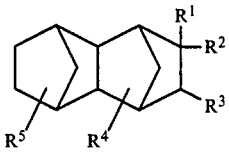

(II)

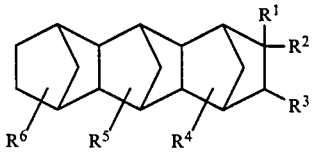

(III)

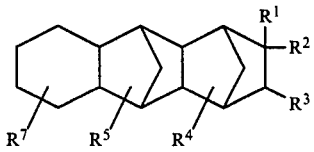

(IV)

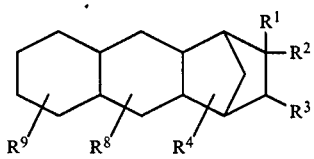

(V)

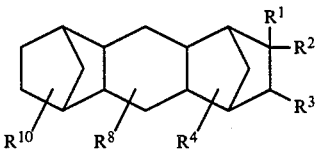

These compounds (I), (II), (III), (IV) and (V) may be directly used as a base stock of traction drive fluids, and have a high traction coefficient. These compounds (I) to (V) are inexpensive since they can be produced from inexpensive starting materials such as unsaturated hydrocarbons having 2 to 11 carbon atoms, cyclopentadiene, methylcyclopentadiene, butadiene, isoprene and piperylene and can be synthesized by utilizing the Diels-Alder reaction which is a thermal reaction. According to the aforesaid synthesis process, a plurality of the Diels-Alder reactions must be carried out. Synthesis intermediates in this process are frequently obtained as by-products of a petrochemical process utilizing cyclopentadiene or butadiene. Hence, if such by-products are utilized, the compounds (I) to (V) in accordance with this invention can be produced at lower costs. The unsaturated hydrocarbons (VII), (VIII), (IX), (XI) and (XII) obtained by the Diels-Alder reactions are unstable to heat and oxidation, whereas the compounds (I) to (V) are stable and can be used over an extended period of time and widely in various machines such as automotive and industrial stepless variable speed gears, and hydraulic machines.

With regard to the measurement of the rolling friction coefficient, Junkatsu (Journal of Japan Society of Lubrication Engineers), Vol. 16, No. 8, page 573 (1971) describes its principle and a measuring device for it. In the present invention it is specifically measured by the following method substantially in accordance with the method described in the above literature reference.

The measuring device is a four-roller type friction tester comprising a center roller (dia. 4 cm) centerlessly supported and three outer rollers (dia. 4 cm each) positioned respectively in contact with the center roller, the three outer rollers being capable of rotating the center roller in a direction opposite to that in which the outer rollers rotate when the outer rollers are each rotated at the same peripheral velocity (1,500 r.p.m.) in the same direction. By using this tester, a load of 207 Kg is applied to the contact surfaces or points and simultaneously a certain braking torque is applied to the driven rotation axle to differentiate the center roller from the outer rollers in the number of rotations (to cause a difference in the number of rotations, that is a slippage) thereby directly measuring the torsional moment of the driven axle of the inner cylinder by the use of a resistant wire distortion tester provided on the axle. The test pieces (inner and outer rollers) are made of carbon steel (JIS S45C), "JIS" standing for "Japanese Industrial Standard", and the greatest Hertz load, based on the load applied to the outer rollers, is 93 Kg/mm2. In the measurement of traction coefficients, the temperature of the traction fluid supplied to the test pieces is adjusted to 25° C. unless otherwise specified.

The traction coefficient is of particular importance in evaluating the properties of a traction drive fluid. Naturally, however, its oxidation stability, pour point, thermal stability, shear stability and abrasion resistance are also taken into consideration. The traction drive fluid in accordance with this invention also has sufficient performance in these additional properties. But to improve further oxidation stability, thermal stability, abrasion resistance, corrosion inihibition on metals, and viscosity index, known additives for traction drive fluids, such as tricresyl phosphate, 2,6-di-t-butyl-p-cresol, poly(alkyl methacrylates), thiophosphate salts and phosphoric diesters may be added as required.

The following examples illustrate the present invention more specifically. It should be understood however that the invention is not limited to them alone.

EXAMPLE 1

(1)

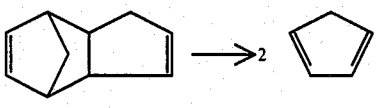

(2)

$CH_3-(CH_2)_2-CH=CH_2$ + 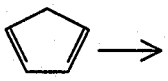

-continued

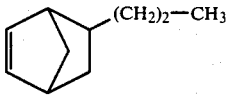

(VIa)

(3)

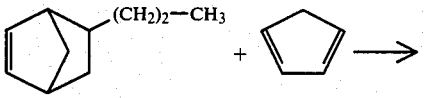

(VIa)

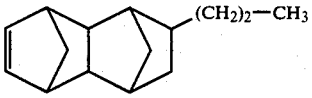

(VIIa)

(4)

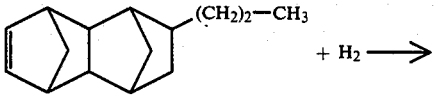

(VIIa)

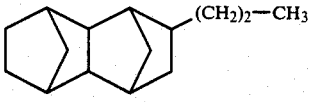

(Ia)

A 1-liter nitrogen-purged stainless steel autoclave adapted to be magnetically stirred was charged with 210 g of 1-pentene and 223 g of dicyclopentadiene, and they were reacted at 170° C. for 19 hours. After the reaction, the reaction mixture was distilled under reduced pressure. The unreacted 1-pentene (143 g) and 52 g of dicyclopentadiene were recovered, and 109 g of 5-propyl-2-norbornene (VIa) was obtained. The conversion of 1-pentene in this Diels-Alder reaction is 32%, and the selectivity of 5-propyl-2-norbornene (VIa) based on the reacted 1-pentene is 83%.

The 5-propyl-2-norbornene (VIa) and dicyclopentadiene were reacted as in the above method to synthesize a 2:1 adduct (VIIa) of cyclopentadiene and 1-pentene in the following manner. Dicyclopentadiene (118 g) and 103 g of 5-propyl-2-norbornene (VIa) were reacted at 165° C. for 30 hours, and the reaction mixture was distilled under reduced pressure. Thirty grams of the unreacted 5-propyl-2-norbornene (VIa) and 35 g of dicyclopentadiene were recovered, and 76 g of a fraction having a boiling point of 94° C./1 mmHg was obtained. This fraction had a molecular weight, measured by a mass spectrometer, of 202. In the IR analysis of this fraction, characteristic absorptions assigned to olefin were observed at 3020 $cm^{-1}$ and 1673 $cm^{-1}$. In the $^1H$-NMR analysis of this fraction, an absorption assigned to hydrogen bonded to the carbon-carbon double bond was observed at δ 6.0 ppm, and an absorption assigned to hydrogen not bonded to the carbon-carbon double bond was observed at δ 0.8 to 3.0 ppm. The area ratio of these peaks was 2:20. From the above data, this product was identified as a 2:1 adduct (VIIa) of cyclopentadiene and 1-pentene. Accordingly, the conversion of 5-propyl-2-norbornene in the Diels-Alder reaction was 71%, and the selectivity of the 2:1 adduct (VIIa) of cyclopentadiene and 1-pentene was 70%.

The 2:1 adduct (VIIa) was hydrogenated by the following procedure. A 500 ml stainless steel autoclave was charged with 74 g of the 2:1 adduct (VIIa) prepared above and 0.7 g of 5% palladium-carbon, and while maintaining the hydrogen pressure at 8 kg/cm$^2$, the 2:1 adduct (VIIa) was hydrogenated at 25° C. When 10 hours elapsed from the start of the reaction, the supply of hydrogen was stopped. Since no absorption of hydrogen was observed at this time, the reaction was terminated. The reaction mixture was taken out of the autoclave, and the catalyst was separated by filtration. The residue was distilled under reduced pressure to give 73 g of a hydrogenation product (Ia) of the 2:1 adduct having a boiling point of 85° C./0.5 mmHg.

This hydrogenation product had a specific gravity (15/4° C.) of 0.95, a pour point of −78° C., a kinematic viscosity of 2.2 cSt (98.9° C.), and a traction coefficient of 0.082 (25° C.)

EXAMPLE 2

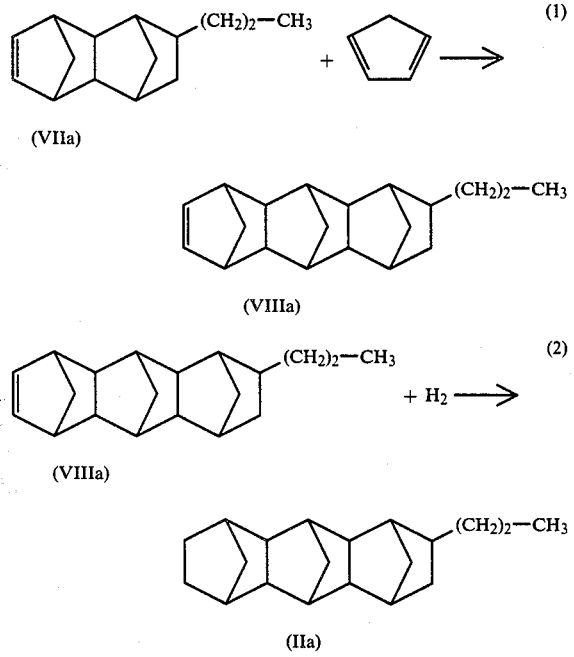

A 2-liter stainless steel autoclave was purged with nitrogen, and charged with 405 g of a 2:1 adduct (VIIa) of cyclopentadiene and 1-pentene. The charge was heated to 120° C. With stirring, cyclopentadiene was introduced at a rate of 200 ml/hr under nitrogen pressure from a 1-liter stainless steel vessel for sample introduction, and reacted with the 2:1 adduct (VIIa) for 5 hours. The total amount of cyclopentadiene added was 750 g.

After the reaction, the undreacted cyclopentadiene was removed, and the residue was distilled under reduced pressure. The unreacted 2:1 adduct (VIIa) (166 g) was recovered, and 233 g of a fraction having a boiling point of 145° C./1 mmHg was obtained. This fraction had a molecular weight, measured by a mass spectrometer, of 268. In the $^1$H-NMR analysis of this fraction, an absorption assigned to hydrogen bonded to the carbon-carbon double bond was observed at δ 6.0 ppm, and an absorption assigned to the carbon-carbobn double bond as observed at δ 0.7 to 3.0 ppm. The area ratio of these peaks was 2:26. These data led to the determination that the product was a 3:1 adduct (VIIIa) of cyclopentadiene and 1-pentene. Accordingly, in the Diels-Alder reaction, the conversion of the 2:1 adduct (VIIa) was 59%, and the selectivity of the 3:1 adduct (VIIIa) was 74%.

A 1-liter stainless steel autocalve was purged with nitrogen, and charged with 230 g of the 3:1 adduct (VIIIa) of cyclopentadiene and 1-pentene and 1.8 g of Raney nickel. With stirring, the 3:1 adduct (VIIIa) was reacted at 45° C. under a hydrogen pressure of 150 kg/cm$^2$. When 7.5 hours elapsed from the start of the reaction, the addition of hydrogen was stopped, and the decrease of the pressure was observed. Sine it was found that there was no consumption of hydrogen at this time, the reaction was terminated. The remaining hydrogen was purged off, and the reaction mixture was taken out. The catalyst was separated from it by filtration, and the residue was distilled under reduced pressure to give 225 g of a hydrogenation product (IIa) of the 3:1 adduct.

The hydrogenation product (IIa) of the 3:1 adduct had a specific gravity (15/4° C.) of 0.99, a pour point of −40° C., a kinematic viscosity of 7.7 cSt (98.9° C.), and a traction coefficient of 0.096 (25° C.).

EXAMPLE 3

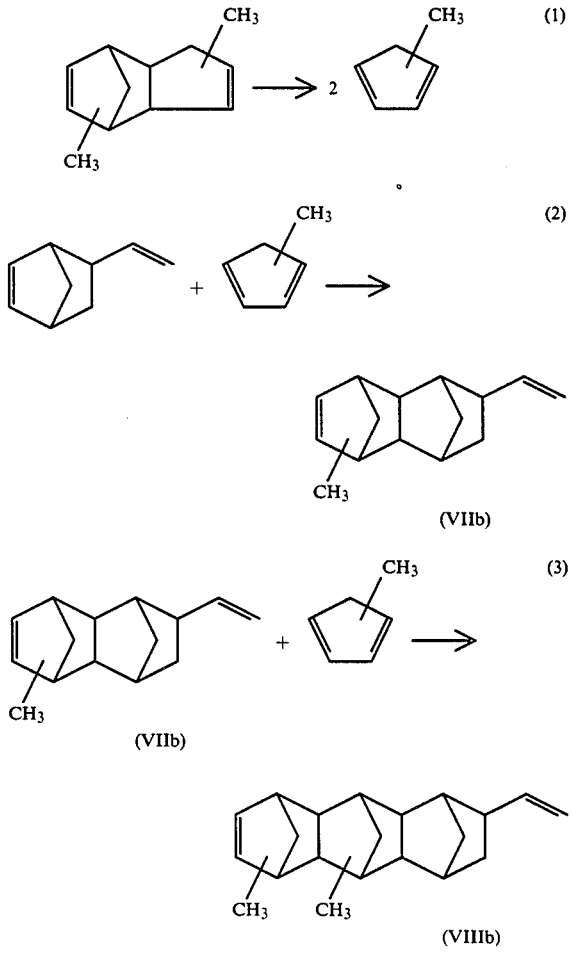

-continued

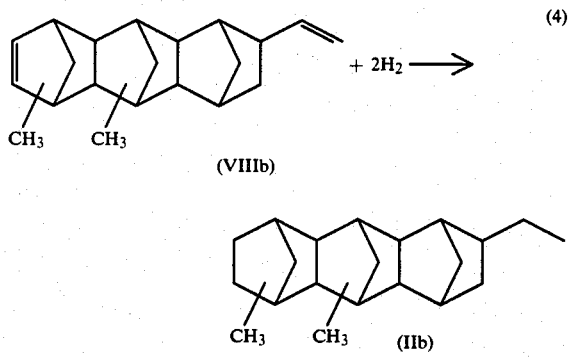

(4)

A 1:1 adduct (VIIb) of methylcyclopentadiene and 5-vinyl-2-norbornene was synthesized as follows from methylcyclopentadiene dimer and 5-vinyl-2-norbornene as starting materials, and then one molecule of methylcyclopentadiene was further reacted with the 1:1 adduct (VIIb) to synthesize a 2:1 adduct (VIIIb) of methylcyclopentadiene and 5-vinyl-2-norbornene.

A 2-liter nitrogen-purged stainless steel autoclave was charged with 362 g of 5-vinyl-2-norbornene and 272 g of methylcyclopentadiene, and they were reacted at 175° C. for 6 hours. After the reaction, the reaction mixture was distilled under reduced pressure. The unreacted 5-vinyl-2-norbornene (88 g) was recovered and 284 g of a 1:1 adduct (VIIb) of methylcyclopentadiene and 5-vinyl-2-norbornene was obtained.

The 1:1 adduct (VIIb) (215 g) and 194 g of methylcyclopentadiene dimer were reacted at 175° C. for 6 hours, and then the reaction mixture was distilled under reduced pressure to give 135 g of a fraction having a boiling point of 131° C./0.2 mmHg. This fraction had a molecular weight, measured by a mass spectrometer, of 280. In its $^1$H-NMR analysis, the area ratio of a peak assigned to hydrogen bonded to the carbon-carbon double bond to a peak assigned to hydrogen not bonded to the carbon-carbon double bond was 5:23. These data led to the determination that this fraction was a 2:1 adduct (VIIIb) of methylcyclopentadiene and 5-vinyl-2-norbornene.

The resulting 2:1 adduct (VIIIb) (130 g) was reacted at 50° C. for 7 hours under a hydrogen pressure of 10 kg/cm$^2$ using 1.1 g of 5% platinum-carbon. After the reaction, the reaction mixture was distilled under reduced pressure to give 128 g of a hydrogenation product (IIb) of the 2:1 adduct.

The hydrogenation product (IIb) had a specific gravity (15/4° C.) of 0.98, a pour point of −4° C., a kinematic viscosity of 10 cSt (98.9° C.) and a traction coefficient of 0.097 (25° C.).

EXAMPLE 4

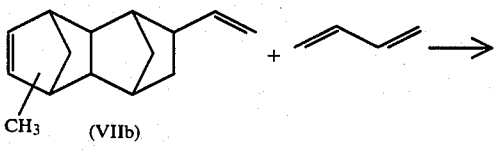

(1)

-continued

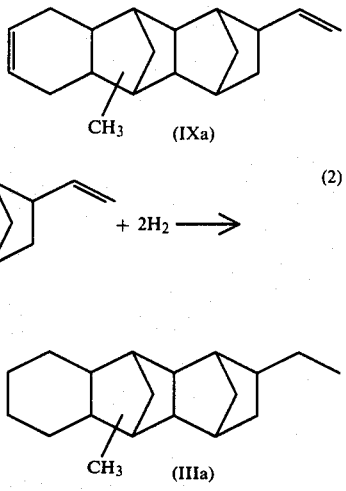

(2)

The 1:1 adduct (VIIb) of methylcyclopentadiene and 5-vinyl-2-norbornene synthesized in Example 3 was subjected to Diels-Alder reaction with butadiene to synthesize a 1:1:1 adduct (IXa) of butadiene, methylcyclopentadiene and 5-vinyl-2-norbornene in the following manner.

A 1-liter autoclave was charged with 254 g of the 1:1 adduct (VIIb) and 216 g of butadiene, and they were reacted at 175° C. for 19 hours. After the reaction, the reaction mixture was distilled under reduced pressure to give 173 g of the 1:1:1 adduct (IXa) mentioned above.

A 1-liter stainless steel autoclave was charged with 170 g of the 1:1:1 adduct (IXa), 1.6 g of palladium black and 300 ml of hexane, and the 1:1:1 adduct (IXa) was hydrogenated at 35° C. under a hydrogen pressure of 10 kg/cm$^2$ for 15 hours. The reaction mixture was distilled under reduced pressure to give 166 g of a hydrogenation product (IIIa) of the 1:1:1 adduct (IXa).

The hydrogenation product had a specific gravity (15/4° C.) of 0.96, a pour point of −42° C., a kinematic viscosity of 6.7 cSt (98.9° C.), and a traction coefficient of 0.093 (25° C.).

EXAMPLE 5

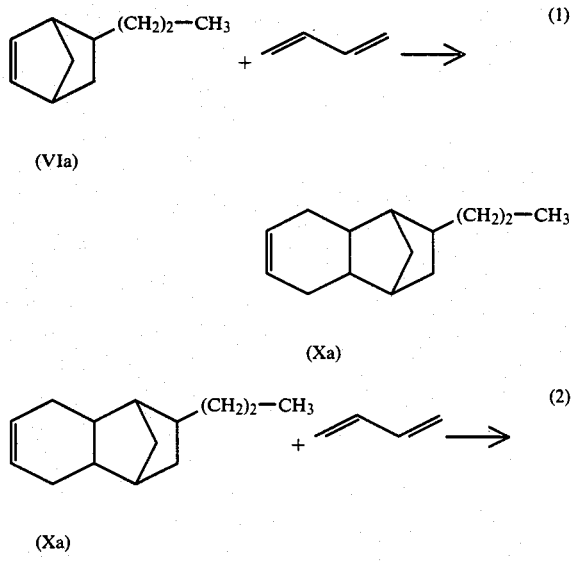

(1)

(2)

-continued

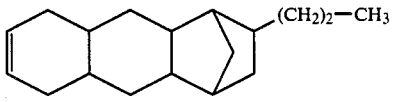

(XIa)

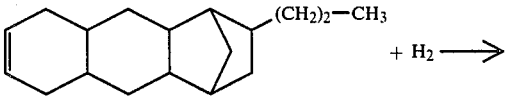

(3)

(XIa)

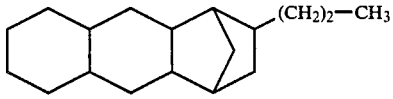

(IVa)

A 1:1 adduct (Xa) of butadiene and 5-propyl-2-norbornene was synthesized from 5-propyl-2-norbornene and butadiene in accordance with the method of Example 1, and the 1:1 adduct was further reacted with butadiene to give a 2:1 adduct (XIa) of butadiene and 5-propyl-2-norbornene. As in Example 1, 272 g of 5-propyl-2-norbornene and 430 g of butadiene were reacted at 170° C. for 25 hours. The reaction mixture was distilled under reduced pressure to give 190 g of the 1:1 adduct (Xa). Furthermore, 190 g of this 1:1 adduct (Xa) and 162 g of butadiene were reacted at 150° C. for 40 hours to give 121 g of the 2:1 adduct (XIa).

Subsequently, 110 g of the 2:1 adduct (XIa) was reacted at room temperature for 15 hours under a hydrogen pressure of 10 kg/cm$^2$ in 300 ml of benzene as a solvent using 3.1 g of 0.2% Pd-alumina catalyst. The catalyst was separated by filtration from the reaction mixture, and the residue was distilled under reduced pressure to give 103 g of the 2:1 adduct (XIa).

The hydrogenation product (IVa) had a specific gravity (15/4° C.) of 0.93, a pour point of −60° C., a kinematic viscosity of 4.0 cSt (98.9° C.) and a reaction coefficient of 0.087 (25° C.).

EXAMPLE 6

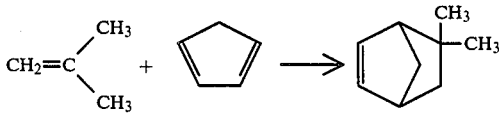

(1)

(VIb)

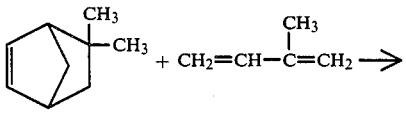

(2)

(VIb)

-continued

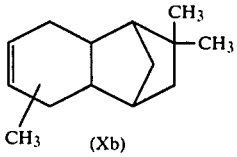

(Xb)

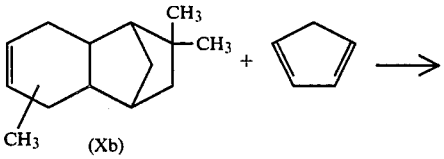

(3)

(Xb)

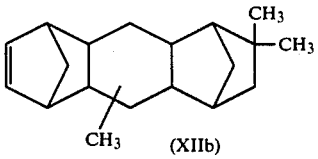

(XIIb)

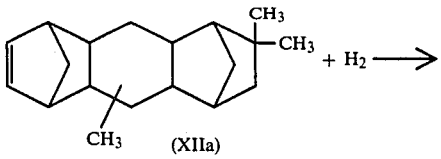

(4)

(XIIa)

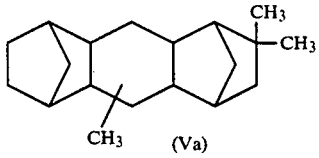

(Va)

A 1-liter nitrogen-purged stainless steel autoclave adapted to be magnetically stirred was charged with 168 g of isobutylene and 297 g of cyclopentadiene, and they were reacted at 175° C. for 29 hours. After the reaction, the reaction mixture was distilled under reduced pressure. The unreacted isobutylene (92 g) was recovered, and 132 g of 5,5-dimethyl-2-norbornene (VIb) which is a 1:1 adduct of isobutylene and cyclopentadiene was obtained.

The resulting 5,5-dimethyl-2-norbornene was subjected to Diels-Alder reaction with isoprene to synthesize a 1:1 adduct (Xb). Specifically, 122 g of 5,5-dimethyl-2-norbornene (VIb) and 204 g of isoprene were reacted as above at 160° C. for 23 hours. The reaction mixture was distilled under reduced pressure to give 123 g of the 1:1 adduct (Xb).

The adduct (Xb) was further reacted with cyclopentadiene to give a 1:1:1 adduct (XIIIa) of cyclopentadiene, isoprene and 5,5-dimethyl-2-norbornene. Specifically, 120 g of the 1:1 adduct (Xb) and 136 g of dicyclopentadiene were reacted at 180° C. for 8 hours. The reaction mixture was distilled under reduced pressure to give 103 g of a fraction having a molecular weight of 256. By its $^1$H-NMR analysis, the area ratio of a peak assigned to hydrogen bonded to the carbon-carbon double bond to a peak assigned to hydrogen not bonded to the carbon-carbon double bond was 2:26. The above data led to the determination that this fraction was a 1:1:1 adduct (XIIa) of cyclopentadiene, isoprene and 5,5-dimethyl-2-norbornene.

The adduct (XIIa) was hydrogenated as follows. A 1-liter stainless steel autoclave was charged with 115 g of the adduct (XIIa), 1.1 g of palladium black and 300 ml of pentane, and the adduct (XIIa) was reacted at 50° C. under a hydrogen pressure of 15 kg/cm$^2$. The supply of hydrogen was stopped when 6 hours passed from the start of the reaction. Sine no absorption of hydrogen was observed at this time, the reaction was terminated. The reaction mixture was taken out from the autoclave, and the catalyst was separated by filtration. The residue was distilled under reduced pressure to give 113 g of a hydrogenation product (Va) of the 1:1:1 adduct (XIIa).

The hydrogenation product had a specific gravity (15/4° C.) of 0.96, a pour point of −40° C., a kinematic viscosity of 6.2 cSt (98.9° C.), and a traction coefficient of 0.092 (25° C.).

EXAMPLE 7

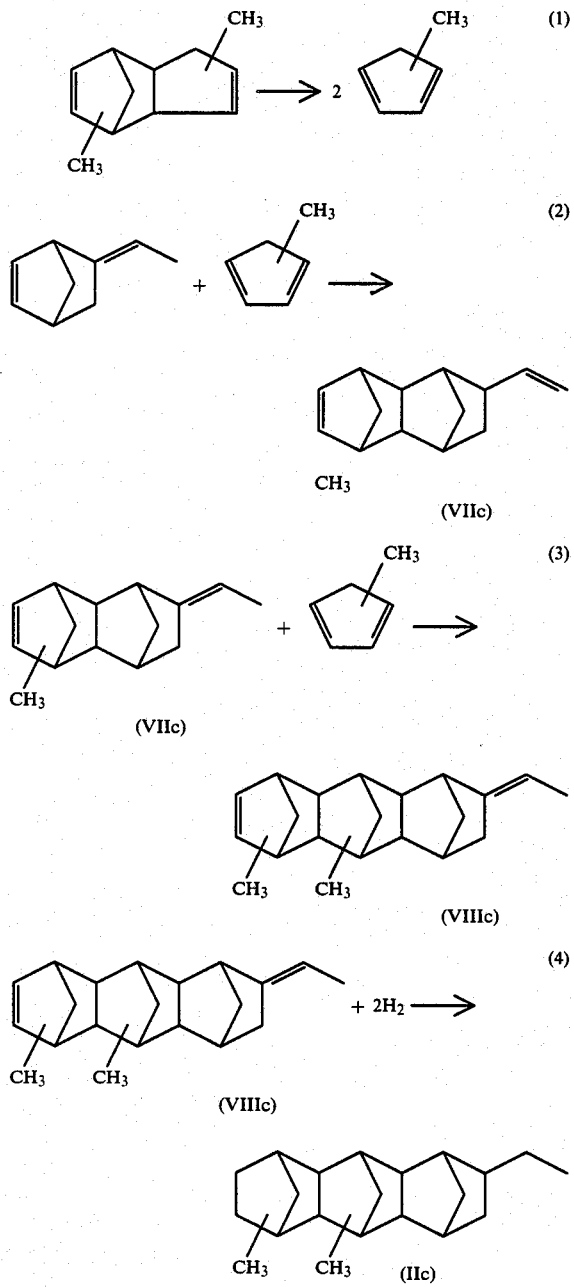

Diels-Alder reaction and hydrogenation were carried out in the same way as in Example 3 except that 5-ethylidene-2-norbornene was used instead of 5-vinyl-2-norbornene. A hydrogenation product (IIc) of a 2:1 adduct of methycyclopentadiene and 5-ethylidene-2-norbornene was obtained.

The hydrogenation product (IIc) had the same properties as the hydrogenation product (IIb) obtained in Example 3.

What is claimed is:

1. A traction drive fluid comprising as a base stock as least one hydrocarbon selected from the group consisting of compounds of the following general formulae (I) to (V)

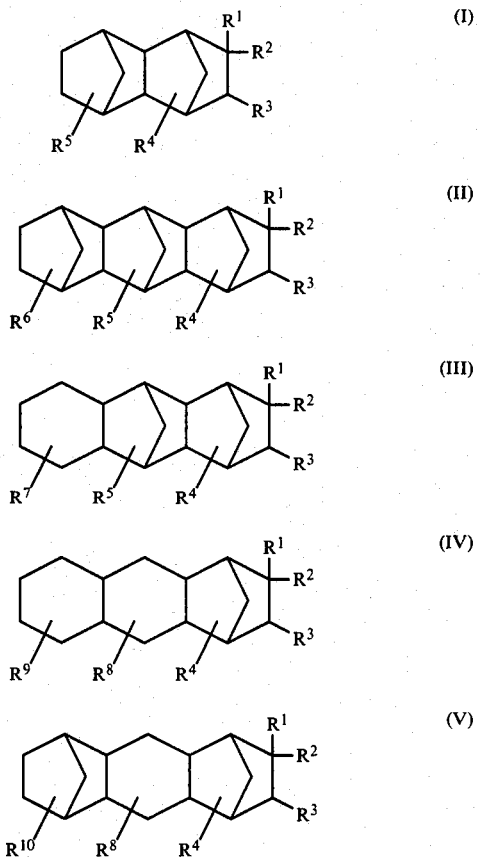

wherein $R^1$, $R^2$ and $R^3$, independently from each other, represent a hydrogen atom or an alkyl group having 1 to 3 carbon atoms, and $R^4$, $R^5$, $R^6$, $R^7$, $R^8$, $R^9$ and $R^{10}$, independently from each other, represent a hydrogen atom or a methyl group.

2. The fluid of claim 1 which contains at least one compound selected from the group consisting of tricresyl phosphate, 2,6-di-t-butyl-p-cresol, poly(alkyl methacrylates), thiophosphoric acid salts and phosphoric diesters.

3. The fluid of claim 1 wherein the compounds of general formulae (I) to (V) are obtained by hydrogenating compounds of the following formulae (VII), (VIII), (IX), (XI) and (XII), respectively,

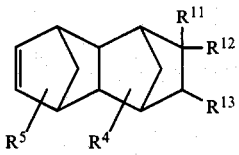

-continued (VIII)

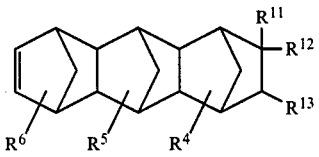

(IX)

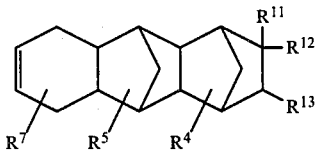

(XI)

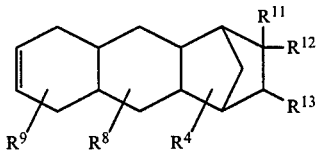

(XII)

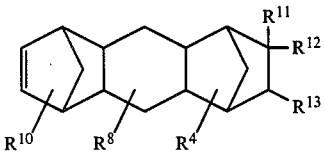

wherein $R^4$, $R^5$, $R^6$, $R^7$, $R^8$, $R^9$, $R^{10}$ are as defined in claim 1, and $R^{11}$, $R^{12}$ and $R^{13}$, indedpendently from each other, represent a hydrogen atom, or an alkyl, alkenyl group, or an alkylidene group having 1 to 3 carbon atoms.

4. The fluid of claim 3 wherein the hydrogenation is carried out at 20° to 225° C. under a hydrogen pressure of 1 to 200 kg/cm$^2$ optionally in a solvent.

5. The fluid of claim 3 wherein the compound of formula (VII) is obtained by the Diels-Alder reaction of a norbornene compound of the following formula (VI)

(VI)

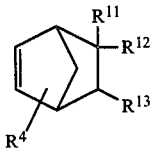

wherein $R^4$, $R^{11}$, $R^{12}$ and $R^{13}$ are as defined in claim 3, with cyclopentadiene and/or methylcyclopentadiene.

6. The fluid of claim 3 wherein the compound of formula (VIII) is obtained by performing the Diels-Alder reaction of a norbornene compound of the following formula (VI)

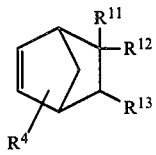

wherein $R^4$, $R^{11}$, $R^{12}$ and $R^{13}$ are as defined in claim 3, with cyclopentadiene and/or methylcyclopentadiene to form a compound of the following formula (VII)

(VII)

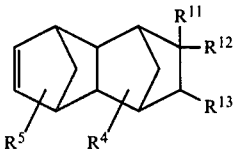

wherein $R^4$, $R^5$, $R^{11}$, $R^{12}$ and $R^{13}$ are as defined in claim 3, and subjecting the resulting compound of formula (VII) to Diels-Alder reaction with cyclopentadiene and/or methylcyclopentadiene.

7. The fluid of claim 3 wherein compound of formula (IX) is obtained by the Diels-Alder reaction of the compound of formula (VII) with at least one compound selected from butadiene, isoprene and piperylene.

8. The fluid of claim 3 wherein the compound of formula (XI) is obtained by performing the Diels-Alder reaction of the compound of a norbornene compound of the following formula (VI)

(VI)

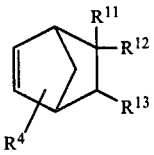

wherein $R^4$, $R^{11}$, $R^{12}$ and $R^{13}$ are as defined in claim 3, with at least one compound selected from the group consisting of butadiene, isoprene and piperylene to form a compound of the following formula (X)

(X)

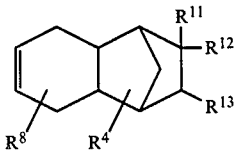

wherein $R^4$, $R^8$, $R^{11}$, $R^{12}$ and $R^{13}$ are as defined in claim 3, and subjecting the resulting compound of formula (X) to Diels-Alder reaction with at least one compound selected from the group consisting of butadiene, isoprene and piperylene.

9. The fluid of claim 3 wherein the compound of formula (XII) is obtained by Diels-Alder reaction of the compound of formula (X) with cyclopentadiene and/or methylcyclopentadiene.

10. The fluid of claim 5, wherein the compound of formula (VI) is obtained by the Diels-Alder reaction of cyclopentadiene and/or methylcyclopentadiene with an unsaturated hydrocarbon of the formula

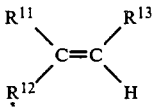

wherein $R^{11}$, $R^{12}$ and $R^{13}$ are as defined in claim 5.

11. The fluid of claim 6 wherein the compound of formula (VI) is obtained by the Diels-Alder reaction of cyclopentadiene and/or methylcyclopentadiene with an unsaturated hydrocarbon of the formula

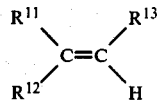

wherein $R^{11}$, $R^{12}$ and $R^{13}$ are as defined in claim 6.

12. The fluid of claim 8, wherein the compound of formula (VI) is obtained by the Diels-Alder reaction of cyclopentadiene and/or methylcyclopentadiene with an unsaturated hydrocarbon of the formula

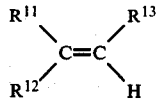

wherein $R^{11}$, $R^{12}$ and $R^{13}$ are as defined in claim 8.

13. The fluid of claim 9 wherein the compound of formula (X) is obtained by performing the Diels-Alder reaction of an unsaturated hydrocarbon of the following formula

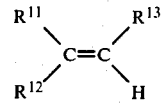

wherein $R^{11}$, $R^{12}$ and $R^{13}$ are as defined in claim 9, with cyclopentadiene and/or methylcyclopentadiene to form a compound of the following formula (VI)

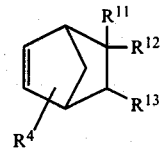

(VI)

wherein $R^4$, $R^{11}$, $R^{12}$ and $R^{13}$ are as defined in claim 9, and subjecting the resulting compound of formula (VI) to Diels-Alder reaction with at least one compound selected from the group consisting of butadiene, isoprene and piperylene.

* * * * *